US005302924A

United States Patent [19]

Jantunen et al.

[11] Patent Number: 5,302,924

[45] Date of Patent: Apr. 12, 1994

[54] TEMPERATURE COMPENSATED DIELECTRIC FILTER

[75] Inventors: Heli Jantunen; Aimo Turunen, both of Oulu, Finland

[73] Assignee: Lk-Products Oy, Kempele, Finland

[21] Appl. No.: 906,214

[22] Filed: Jun. 25, 1992

[30] Foreign Application Priority Data

Jun. 25, 1991 [FI] Finland ..... 913087

[51] Int. Cl.[5] ..... H01P 1/20

[52] U.S. Cl. ..... 333/202; 333/206

[58] Field of Search ..... 333/202, 206, 134, 204, 333/205, 206, 207, 246, 222, 219.1, 234

[56] References Cited

U.S. PATENT DOCUMENTS

| | | | |
|---|---|---|---|
| 4,464,640 | 8/1984 | Nishikawa et al. | 333/202 |
| 4,559,506 | 12/1985 | Capek | 333/206 |
| 4,965,537 | 10/1990 | Kommrusch | 333/202 |
| 5,010,309 | 4/1991 | Manssen et al. | 333/202 |
| 5,015,974 | 5/1991 | Komazaki et al. | 333/134 |
| 5,103,197 | 4/1992 | Turunen et al. | 333/206 |
| 5,202,653 | 4/1993 | Yamada et al. | 333/202 |
| 5,202,654 | 4/1993 | Heine | 333/206 |

FOREIGN PATENT DOCUMENTS

| | | | |
|---|---|---|---|
| 0157216 | 10/1985 | United Kingdom | 333/202 |

*Primary Examiner*—Raymond A. Nelli
*Attorney, Agent, or Firm*—Darby & Darby

[57] ABSTRACT

A temperature compensated filter comprises a block (1) of dielectric material having at least one transmission line resonator (3) formed herein. All surfaces except one side surface of the block are substantially coated with an electrically conductive layer (11). For achieving temperature compensation, a capacitor (6) coupled to the conductive layer (11) through a strip line (7) is attached, in a heat conductive way, to the uncoated side surface of the dielectric block. The capacitor (6) tunes the main resonator and the temperature dependence of its frequency is opposite that of the dielectric body so that it compensates the temperature dependence of the frequency of the main resonator.

10 Claims, 1 Drawing Sheet

TEMPERATURE COMPENSATED DIELECTRIC FILTER

BACKGROUND OF THE INVENTION

The present invention relates to a temperature compensated filter comprising a body of dielectric material having at least one transmission line resonator formed therein.

A dielectric filter is disclosed in European patent application EP-A-0,401,839 and corresponding U.S. Pat. No. 5,103,197, comprising a body of dielectric material which has upper and lower surfaces, two side surfaces, two end surfaces, and at least one hole extending from said upper surface towards said lower surface, an electrically conductive layer covering major portions of the lower surface, one side face, both end faces and the surface of said at least one hole so as to form said at least one transmission line resonator.

The properties required from the dielectric material are a high proportional dielectrical coefficient $\epsilon r$ and a small dissipation coefficient. The difficulty with this is that although materials with sufficiently high dielectric coefficients (about 8–100) and low temperature dependence, are available on the market they are relatively expensive and difficult to procure. Relatively good $\epsilon r$ values and a low temperature dependence of frequency can be obtained with ceramic compounds, for example, but the dissipation coefficients generally increase in these compounds.

The purpose of the present invention is to arrange, by using comparatively simple means, the temperature compensation of the frequency of a dielectric filter in which the material of the dielectric body can be chosen relatively freely on the basis of price and an advantageous dissipation coefficient.

According to the present invention a dielectric filter having the features mentioned in the opening paragraph above is characterized in that a capacitor is coupled to the transmission line resonator for tuning the filter and having a temperature coefficient of frequency opposite that of the dielectric body.

The capacitor itself forms part of the resonance circuit the frequency of which varies with temperature in the opposite sense to the frequency variation of the filter. Since the capacitor is coupled to the "main" transmission line resonator it has the effect of temperature compensating the filter.

Suitably, the filter may have a structure in accordance with that disclosed and claimed in the aforementioned European patent application and the corresponding US patent.

The capacitor may be a so-called chip capacitor which is attached to the dielectric body adjacent the hole therein, preferably on a side surface where the conductive layer is not present.

In a preferred embodiment the capacitor has one terminal electrically coupled to the electrically conductive layer, preferably through a conductive strip provided on the side surface of the dielectric body where the conductive layer is not present. The other terminal of the capacitor may also be coupled to a further conductive strip on the same side face.

BRIEF DESCRIPTION OF THE DRAWINGS

An embodiment of the invention will now be described, by way of example, with reference to the accompanying drawings in which.

DESCRIPTION OF THE PREFERRED EMBODIMENT

Figure 1:
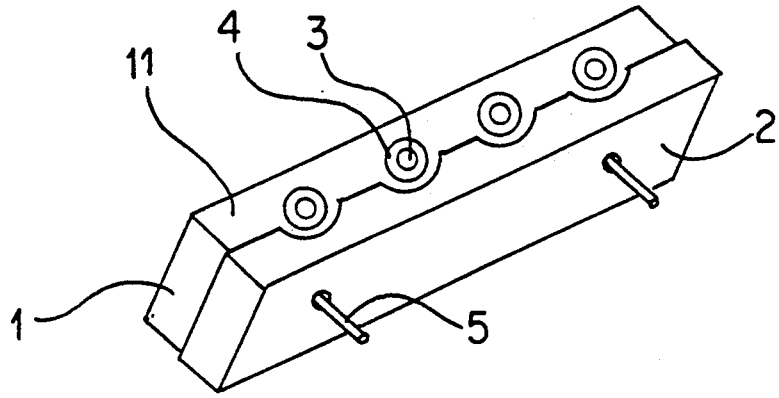
FIG. 1 is a perspective view of a dielectric filter in accordance with the invention.
Figure 2:
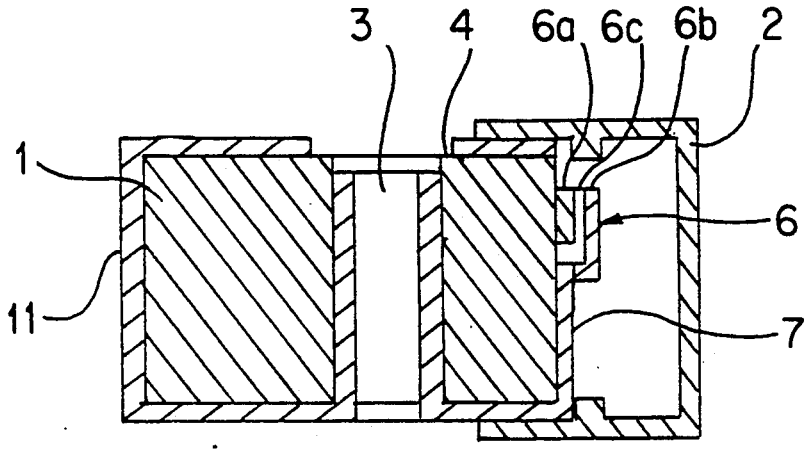
FIG. 2 is a cross section of the filter in FIG. 1.

As shown in FIGS. 1 and 2, the filter comprises a ceramic block 1 substantially covered with a conductive layer 11, except for one side surface. A cover plate 2, made of pressed metal overlies the uncoated surface of the block. The holes 3 extend through the block 1 and these are coated with the conductive layer 11 thus forming respective transmission line resonators. Areas 4 around the holes on the top surface of the block are left free of conductive material. As disclosed in detail in the aforementioned European patent application and corresponding US patent, and electrode pattern is provided on the uncoated side surface of the dielectric block to allow coupling to the resonator and between adjacent resonators. It is noted here that the coupling to the resonators is generally inductive at the lower parts of the ceramic block and generally capacitive at the upper parts. Coupling pins 5 which extend through the metal cover 2 permit coupling to the filter via the electrode pattern on the side surface.

Figure 3:
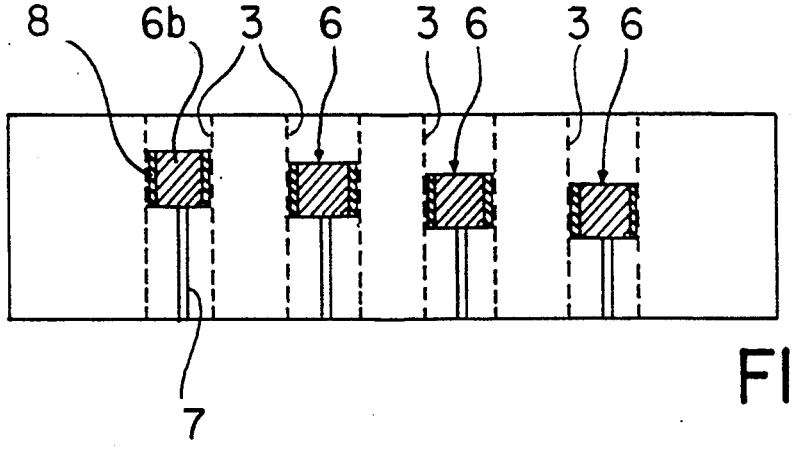
FIG. 3 is a side view of the filter in FIG. 1 (with the conductive cover omitted).

In accordance with the invention, a capacitor 6, connected to the dielectric block in a thermally conductive manner, is placed on the uncoated side surface of the filter i.e. the same surface on which the electrode pattern is situated, for compensating the temperature dependence of the frequency of the dielectric substance of the base block. Lower surface **6*a* of the capacitor is attached to separate ends of strip lines 8 present on the side surface of the block as shown in FIGS. 2 and 3; whereas the upper conductive surface 6*b* is connected to coating 11 of the base block through strip line 7. The material of dielectric layer 6*c*** of the chip-type capacitor, for example, is so chosen that this capacitor which tunes the main resonator comprises an opposite temperature dependence of frequency with respect to the main resonator.

Because the connection in the upper part of the filter is mainly capacitive and inductive in the lower part thereof, as stated above, the capacitor is placed in the upper part. Thus it is comprehended that a shunt connection of inductance (formed by strip line 7) and capacitance is formed in which the temperature dependence of the capacitance varies in an opposite direction with respect to the material of the base block.

It will be evident that the capacitor can be of a type other than the chip capacitor shown in the drawing and that its attachment may also be different.

In FIG. 3 it is shown that the position of the temperature compensating capacitor 6 may vary from resonator to resonator. Alternatively, the capacitors 6 may be provided at the same position at some or all of the resonators.

The amount of compensation of the temperature dependence of the frequency of the main resonator 3 depends on the temperature coefficient of the compensating capacitor 6 as well as on the strength of coupling between the main resonator 3 and the side resonator circuit, as the combination of the capacitor 6 and the strip lines 7, 8 could be called. The strength of coupling depends on the distance between the main resonator 3 and the side resonator circuit so that the shorter the distance is, the stronger is the coupling between the main resonator 3 and the side resonator circuit. Besides temperature compensation the side resonator circuit affects the resonance frequency of the main resonator 3. The Q value of the side resonator circuit is smaller, i.e. the losses are greater than of the main resonator 3. Therefore the resonance frequency of the side resonator circuit should be chosen so that it does not deteriorate the characteristics of the main resonator. The resonance frequencies of the main resonator and the side resonator circuit should therefore differ enough in order to avoid disturbances. When the resonance frequency of the main resonator is for example around 900 MHz the resonance frequency of the side resonator circuit should be at least above 1 GHz, for example 1300 MHz. The position of the temperature compensating capacitor affects the main resonator, so that the closer it is to the capacitive end of the main resonator, the stronger it affects the temperature compensation and the frequency of the main resonator.

We claim:

1. A temperature compensated filter comprising a body of dielectric material having at least one transmission line resonator formed therein, and a capacitor coupled to said transmission line resonator for tuning said filter and having a temperature coefficient of frequency opposite that of the dielectric body.

2. A temperature compensated filter as in claim 1, wherein said body of said dielectric material has upper and lower surfaces, two side surfaces, two end surfaces, and at least one hole extending from said upper surface towards said lower surface, and an electrically conductive layer covering major portions of said lower surface, one of said two side surfaces, both of said two end surfaces and a surface defining said at least one hole so as to form said at least one transmission line resonator.

3. A temperature compensated filter as in claim 2, wherein said capacitor is present opposite to one of said two side surfaces of said body of dielectric material adjacent said at least one hole.

4. A temperature compensated filter as in claim 2 or claim 3, wherein said capacitor has one terminal electrically coupled to said electrically conductive layer.

5. A temperature compensated filter as in claim 4, wherein said one terminal of said capacitor is coupled to said electrically conductive layer through a conductive strip provided on the other of said two side surfaces of said block of dielectric material.

6. A temperature compensated filter as in claim 4 or claim 5, wherein said capacitor has another terminal electrically coupled to a further conductive strip provided on the other of said two side surfaces of said block of dielectric material.

7. A temperature compensated filter as in claim 3, wherein said capacitor is present on the other of said two side surfaces of said block of dielectric material at a location which

8. A temperature compensated filter as in claim 2, wherein said capacitor is a chip capacitor, attached to the other of said two side surfaces of said block of dielectric material.

9. A temperature compensated filter as in claim 2, wherein said body of dielectric material has at least two holes extending from said upper surface towards said lower surface, said at least two holes each being bounded by a surface which is covered by said conductive layer so as to form at least two resonators, further comprising respective capacitors each having a temperature coefficient of frequency opposite to that of said dielectric body and being provided on the other of said two side surfaces of the body of dielectric material adjacent said at least two holes.

10. A temperature compensated filter as in claim 9, wherein the respective capacitors are provided at different positions in a longitudinal direction of said holes.

* * * * *